US006041698A

United States Patent [19]

Chin-Chang et al.

[11] Patent Number: 6,041,698

[45] Date of Patent: Mar. 28, 2000

[54] GUIDE BAND PACKAGING MACHINE

[75] Inventors: Liu Chin-Chang, Taichung; Su Chi-Chan, Taipei, both of Taiwan

[73] Assignees: Tekpak Corporation, Taichung; Transpak Equipment Corporation, Taipei, both of Taiwan

[21] Appl. No.: 09/274,041

[22] Filed: Mar. 22, 1999

[51] Int. Cl.[7] ..... B65B 13/22; B65B 13/06

[52] U.S. Cl. ..... 100/26; 53/589; 100/29; 100/32

[58] Field of Search ..... 100/26, 29, 32; 53/589

[56] References Cited

U.S. PATENT DOCUMENTS

| | | | |
|---|---|---|---|
| 2,215,121 | 9/1940 | Harvey et al. | 100/26 |
| 3,318,230 | 5/1967 | Hilton | 100/26 |
| 3,327,618 | 6/1967 | Cook | 100/26 |
| 4,516,488 | 5/1985 | Bartzick et al. | 100/32 |
| 4,559,767 | 12/1985 | Takami | 100/32 |
| 4,817,519 | 4/1989 | Brouse et al. | 100/32 |
| 5,083,412 | 1/1992 | Sakaki et al. | 100/29 |
| 5,377,477 | 1/1995 | Haberstroh et al. | 100/32 |
| 5,640,899 | 6/1997 | Bell et al. | 100/32 |

FOREIGN PATENT DOCUMENTS

| | | | |
|---|---|---|---|
| 626848 | 12/1981 | Switzerland | 100/32 |

*Primary Examiner*—Stephen F. Gerrity
*Attorney, Agent, or Firm*—Harrison & Egbert

[57] ABSTRACT

A guide band packaging machine having a control motor mounted on a mounting board with a connector member. The connector member is connected to control cam. The control cam has a convex ridge contacting a guide wheel of a link mechanism positioned below the guide motor. The guide motor includes a first motor which rotates a first driver gear mounted on a motor shell. The first driver gear is fixedly attached to a major wheel and rotatably engages a second driver wheel. The second driver wheel is fixedly attached to a minor wheel. The major wheel and the minor wheel are pressed against each other so as to control a tension of a band during the feeding and reversing of the band therebetween.

1 Claim, 10 Drawing Sheets

GUIDE BAND PACKAGING MACHINE

FIELD OF THE INVENTION

The present invention relates generally to a packaging machine, and more particularly to the band that is guided in controlled conditions to avoid curves and deformations in the band while in the process of packaging.

BACKGROUND OF THE INVENTION

As illustrated in FIGS. 1 and 2, the mechanism of the conventional guide band packaging machine is constructed of a bottom receiving seat 10 and an upper receiving seat 11 which are aligned along the inner walls by feed wheels 12 and 121 and reversing wheels 13 and 131. Both sides of the bottom receiving seat 10 have blockers 14 located in the center of the upper edge of seat 10, so that the two blockers 14 connect to the center of the lower edge of upper receiving seat 11. The central shafts of feed wheels 12 and 121 and reversing wheels 13 and 131 extend outwardly from the outer walls of the bottom receiving seat 10 and upper receiving seat 11 and fixedly attach to gears 15, 16, 17, 18. As shown in FIG. 2, feed wheel 12 corresponds to gear 15, feed wheel 121 corresponds to gear 16, reversing wheel 13 corresponds to gear 17, and reversing wheel 131 corresponds to gear 18. Gear 15 engages gear 16, and gear 17 engages gear 18. Moreover, the central shaft of reversing wheel 13 of the bottom receiving seat 10 is fixedly attached to gear 17 and main gear 2. Main gear 2 is engaged with gear 15 of feed wheel 12 of the bottom receiving seat 10. The main gear 2 is driven by the motor, so that rotation of main gear 2 causes feed wheels 12 and 121 to rotate in the opposite direction of the reversing wheels 13 and 131.

As shown in FIG. 3, there is an electromagnet 19 on one side of the bottom receiving seat 10. The vertical shaft rod 20 of the electromagnet 19 is connected to a seat frame 21. The seat frame 21 is mounted to a fixed seat 22 at one end thereof, so that the top end of seat frame 21 connects to a vertical rod 23. The vertical rod 23 is further connected to a horizontal bar member 24 that is attached to the end of the upper receiving seat 11, having feed wheel 121.

As illustrated in FIGS. 4 and 5, when the conventional guide band packaging machine needs to feed or reverse the band, it uses the vertical shaft rod 20 of the electromagnet 19 to pivot the upper receiving seat 11. When the shaft rod 20 retracts, the connected seat frame 21, the vertical rod 23, and the horizontal bar member 24 cause the end of the upper receiving seat 11 to lower. Therefore, the feed wheel 121 of the upper receiving seat 11 presses against the feed wheel 12 of the bottom receiving seat 10. Also, gear 15 engages gear 16. At the same time, the reversing wheel 131 is pivoted upwardly and is separated from reversing wheel 13 and disengages gears 17 and 18, so that the main gear 2 rotatably engages gear 15 of feed wheel 12, which rotates gears 15 and 16 and feeds forward band 1, as shown in FIG. 4.

To reverse the band 1, the vertical shaft rod 20 of electromagnet 19 extends upwardly, which causes the upper receiving seat 11 to pivot in the other direction. As a result, the feed wheels 12 and 121 are separated at a proper distance to disengage gears 15 and 16 and gear 15 and main gear 2. Gears 17 and 18 become rotatably engaged so that the reversing wheel 131 of upper receiving seat 11 presses against the reversing wheel 13 of the bottom receiving seat 10, and band 1 moves in reverse, as shown in FIG. 5.

Therefore, the feeding and reversing of the band use the feed wheels 12 and 121 and reversing wheels 13 and 131 to move the band 1 forward and reverse. As such, the band 1 will be deformed by the continuous feeding and reversing. Furthermore, if the band is deformed,, it will cause problems feeding and reversing. As a result, it will affect the operation of the packaging machine.

SUMMARY OF THE INVENTION

It is therefore the primary objective of the present invention to provide an improved packaging machine in which the band is guided in controlled conditions to avoid curves and deformations in operation.

The feature of the present invention is that two separate phases control the tension in the band. First, a guide motor drives a major wheel and a minor wheel. Second, a control motor drives a control cam to change the tension on the band. By two separate phases, the band can maintain a smooth appearance and can further maintain the effective operation of packaging.

DETAILED DESCRIPTION OF THE INVENTION

Figure 1:
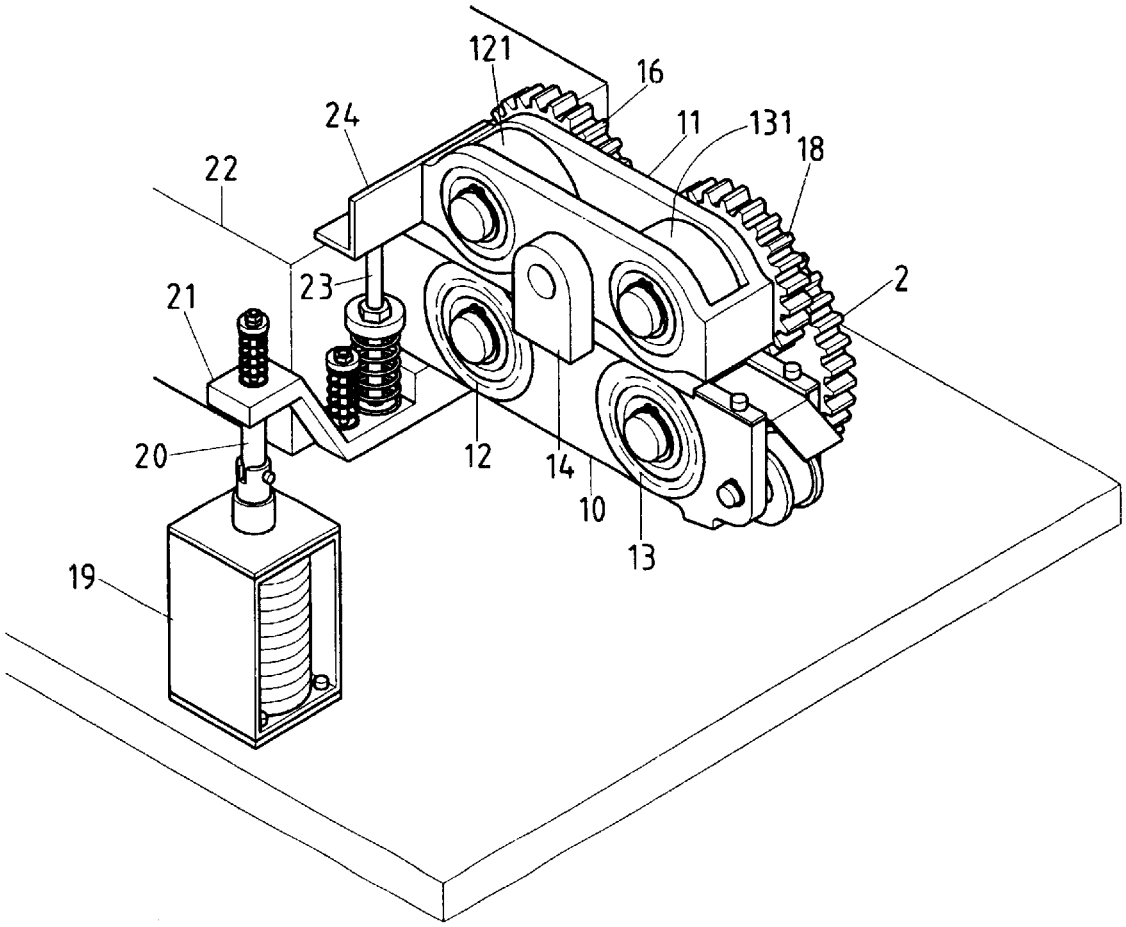
FIG.1 PRIOR ART
FIG. 1 shows a perspective view of a prior art guide band package machine.
Figure 2:
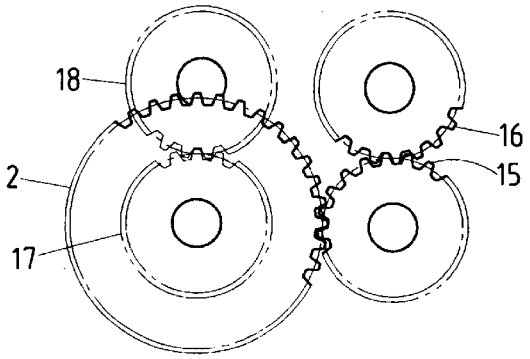
FIG.2 PRIOR ART
FIG. 2 shows a schematic view of the gears of the prior art guide band package machine.
Figure 3:
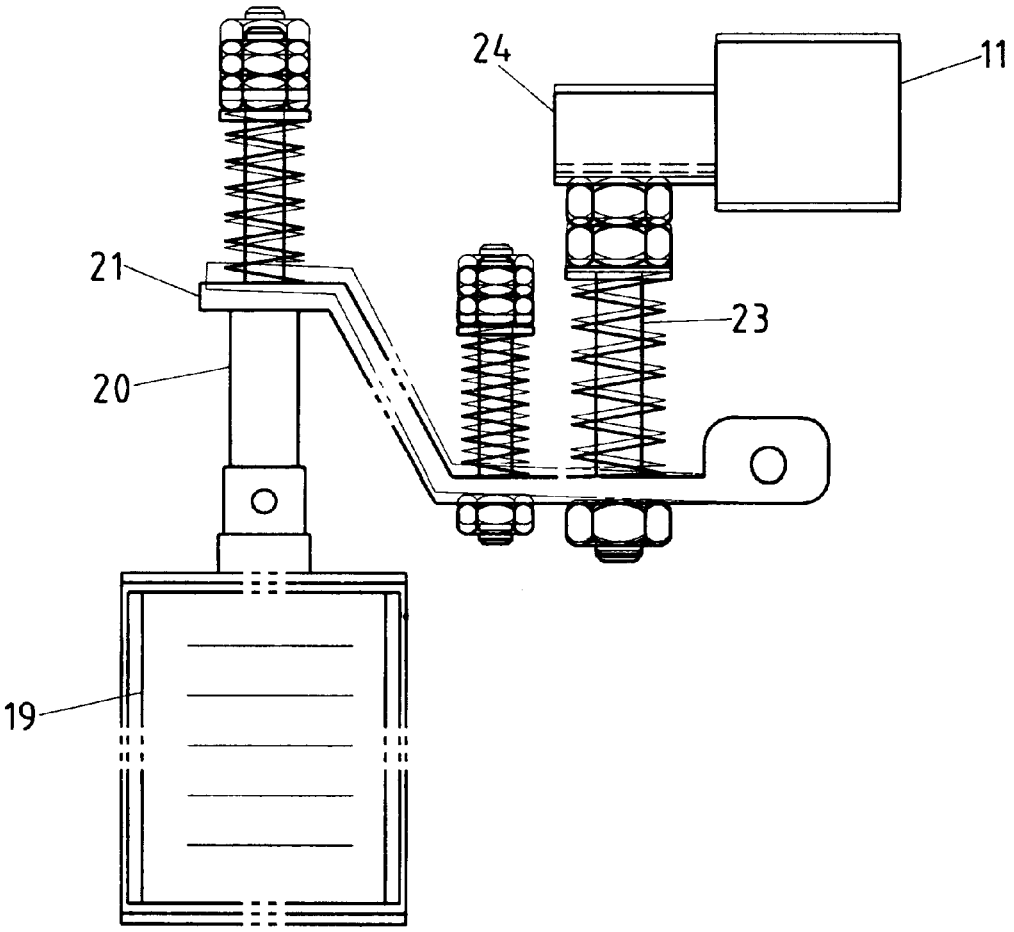
FIG. 3 PRIOR ART
FIG. 3 shows a schematic plan view of the electromagnetic set-up in a prior art guide band package machine.
Figure 4:
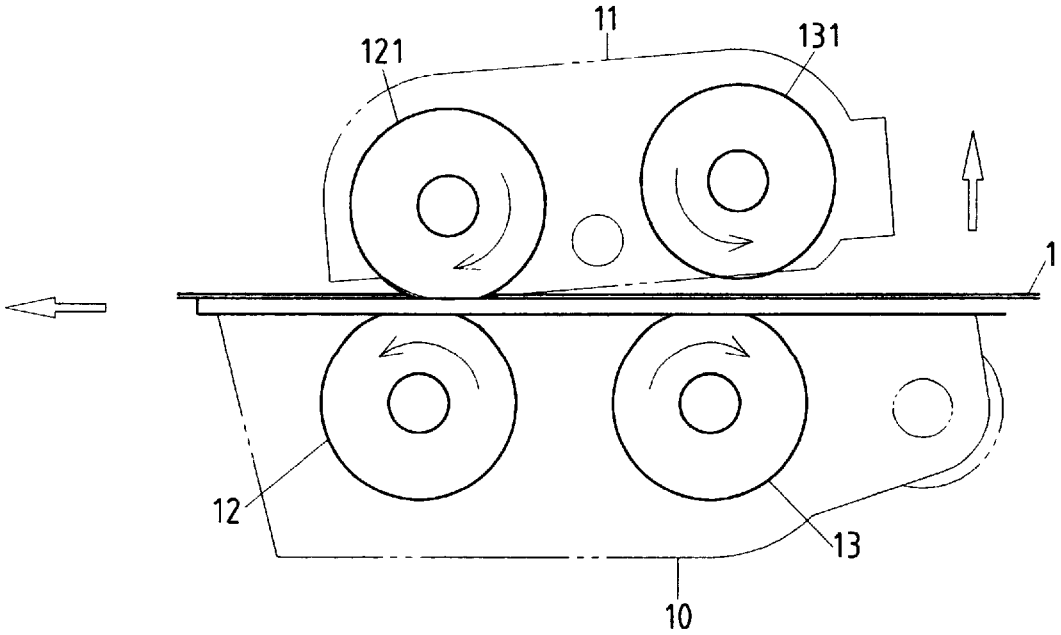
FIG. 4 PRIOR ART
FIG. 4 shows a schematic plan view of the prior art guide band package machine in feeding the band.
Figure 5:
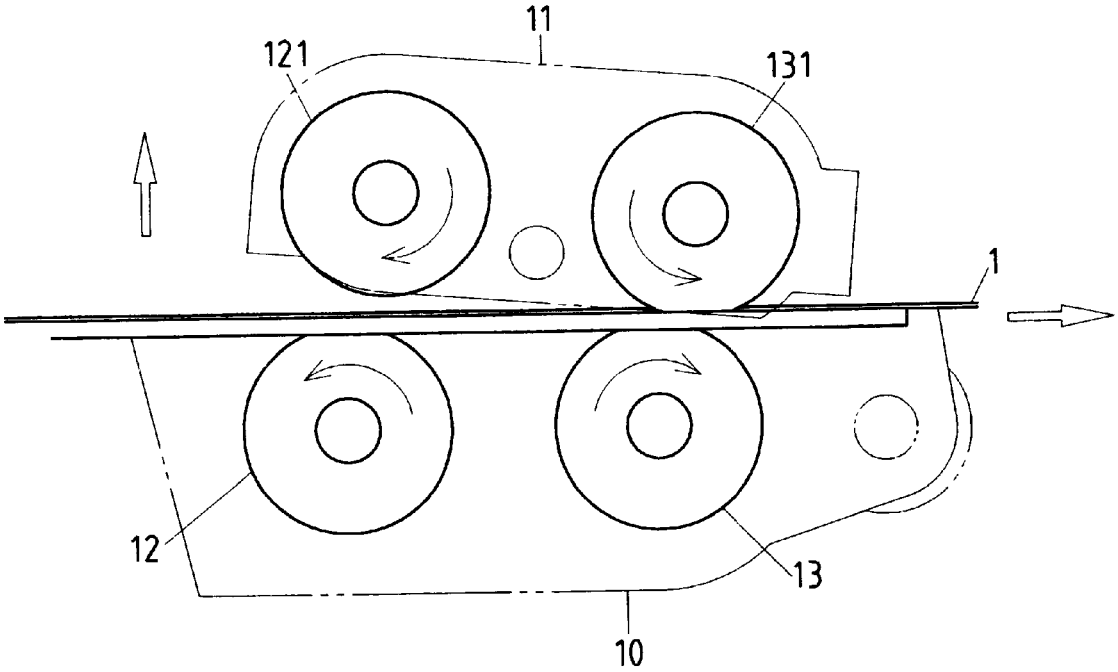
FIG.5 PRIOR ART
FIG. 5 shows a schematic plan view of the prior art guide band package machine in reversing the band.
Figure 6:
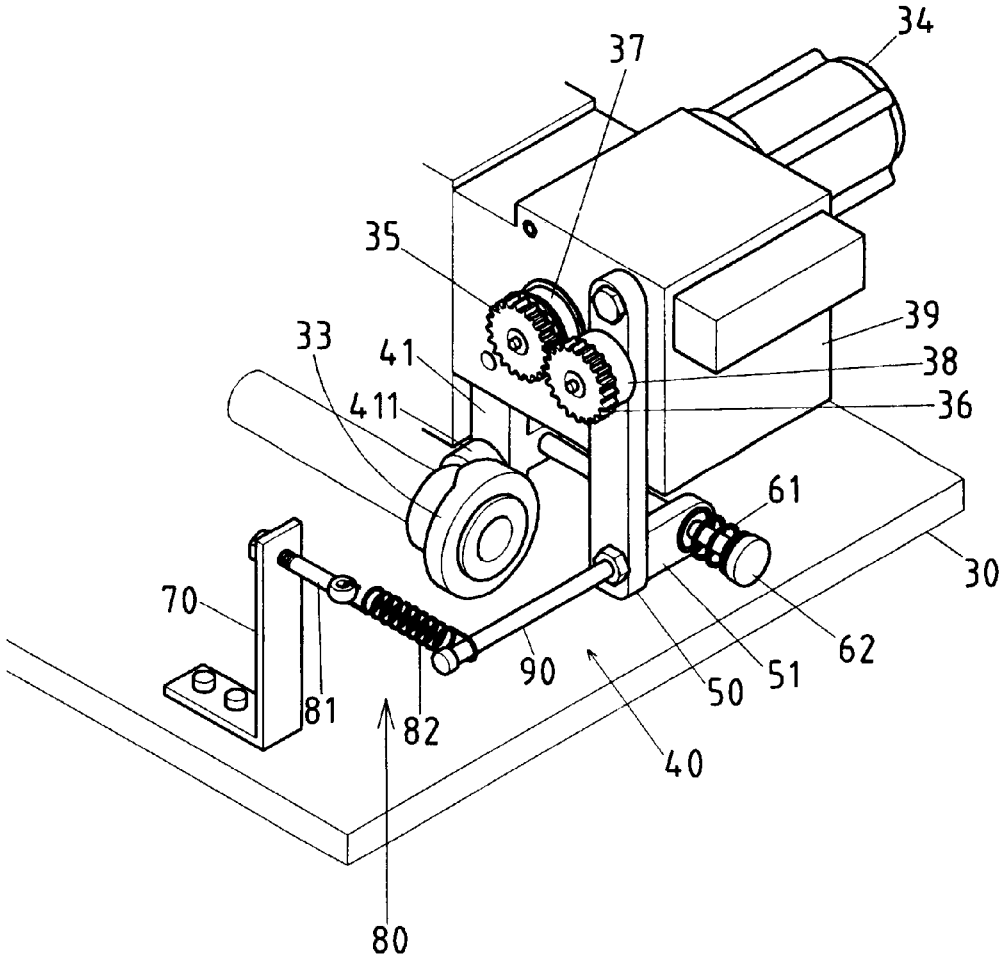
FIG. 6 shows a perspective view of the present invention.
Figure 7:
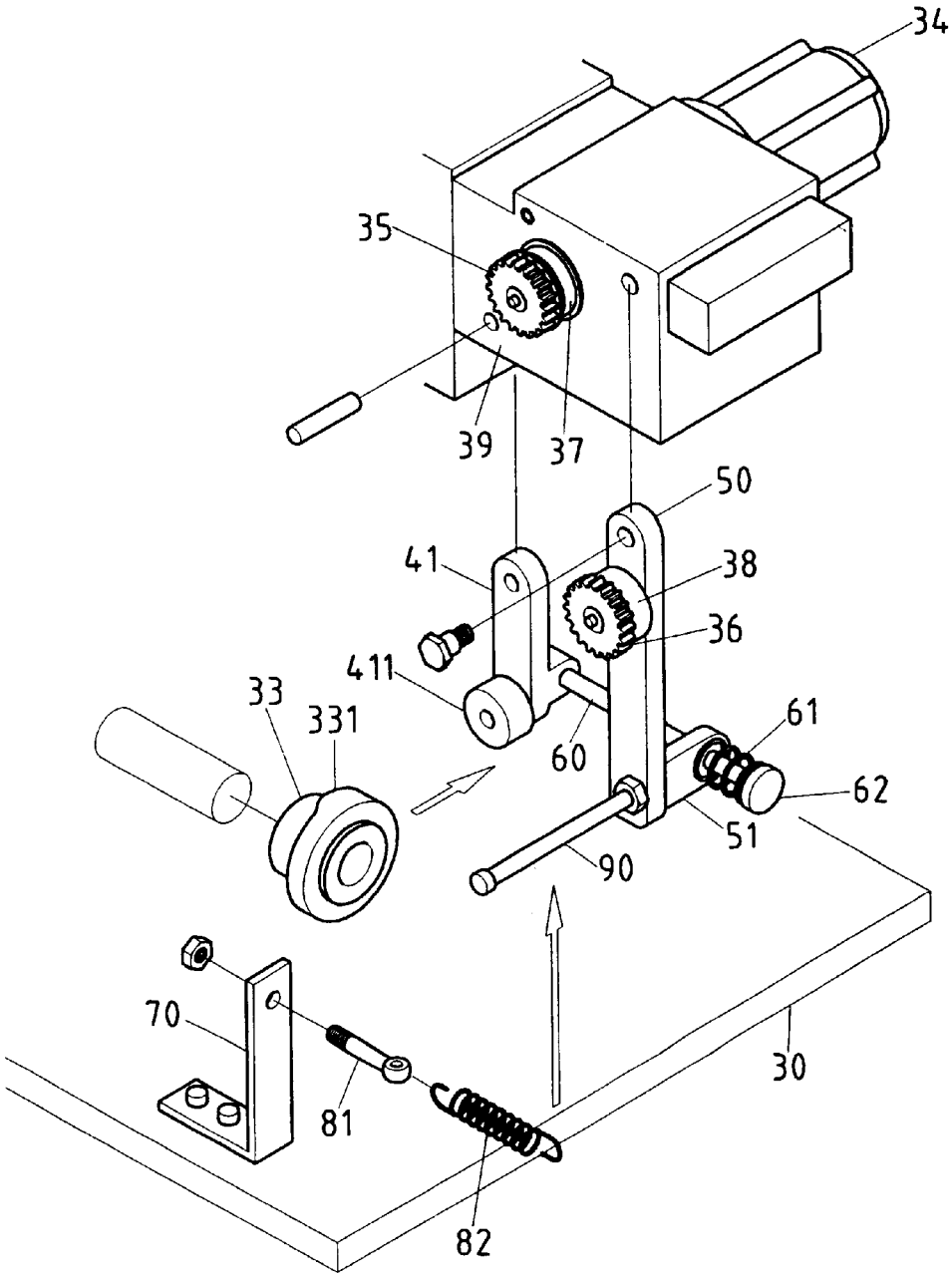
FIG. 7 shows an exploded view of the present invention.
Figure 8:
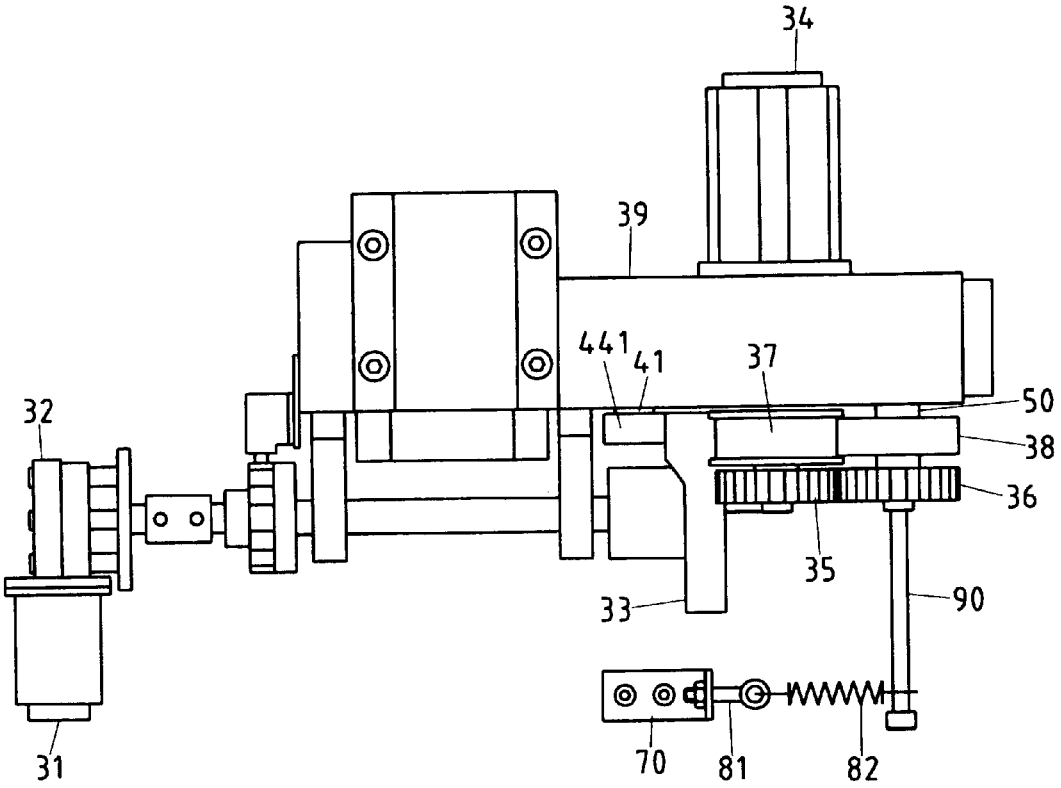
FIG. 8 shows an upper perspective view of the present invention.

As illustrated in FIGS. 6, 7, and 8, the improved band guide packaging machine of the present invention includes a control motor 31, a control cam 33, a guide motor 34 and a link mechanism 40.

The control motor 31 is a motor mounted on mounting board 30 with a connector device 32, which is connected to control cam 33. The connector device 32 causes the control motor 31 to rotate the control cam 33.

The control cam 33 is a horizontally mounted shaft extending from the connector device 32 to the guide motor 34. The end of control cam 33 has a convex ridge 331. The rotation of the control cam 33 causes the convex ridge 331 to contact guide wheel 411 of the link mechanism 40 under the guide motor 34.

The guide motor 34 is a second motor which rotates driver gear 35 as mounted on motor shell 39. Driver gear 35 is fixedly attached to the major wheel 37 and rotatably engages driver gear 36. Driver gear 36 is fixedly attached to the minor wheel 38. Major wheel 37 and minor wheel 38 press against each other and control the tension of the band during feeding and reversing of the band therebetween.

The link mechanism 40 connects the control cam 33 and the guide motor 34. The link mechanism allows the control cam 33 to control the tension of the feeding or reversing of the major wheel 37 and the minor wheel 38, as shown in FIGS. 7 and 8. The link mechanism 40 includes a major rotary arm 41, a minor rotary arm 50, a main link rod 60, a fixed element 70, a spring component 80, and an auxiliary link rod 90.

The top end of the major rotary arm 41 is pivotally mounted on motor shell 39 of guide motor 34. The bottom end facing the control cam 33 has a guide wheel 411. The control cam 33 can rotate so that the convex ridge 331 on the end of the control cam 33 contacts the guide wheel 411. Once in contact, the convex ridge 331 pushes the guide wheel 411 so that the major rotary 41 pivots on its axis at the top end of the arm 41 and moves horizontally towards the control motor 31.

The top end of the minor rotary arm 50 also pivotally mounted on the motor shell 39. However, the pivot point of the minor rotary arm 50 is located farther away from the control cam 33 and above the driver gear 36. Furthermore, the driver gear 36 and its corresponding minor wheel 38 are rotatably mounted ton the minor rotary arm 50 near the top end thereof, but still aligned with driver gear 35 and major wheel 37. The bottom end of minor rotary arm 50 extends downwardly towards mounting board 30 and has a block 51 attached thereto. The block 51 is aligned with the bottom end of the major rotary arm 41.

The main link rod 60 connects horizontally been the bottom ends of the major rotary arm 41 and the minor rotary arm 50. One end of the main link rod 60 is attached to the bottom of major rotary arm 41, and the other end extends through block 51 at the bottom of minor rotary arm 50. The portion of rod 60, extending through the block 51 has a spring 61, which is fastened with a fixed button 62. Thus, the main link rod 60 connects the arms 41 and 50, so that both arms 41 and 50 pivot and move the same.

The fixed element 70 is mounted on the mounting board 30 near the side of the control cam 33.

The spring component 80 includes pull rod 81, which is affixed to the top end of fixed element 70 and parallel to the control cam 33, and spring 82, which hooks together pull rod 81 and auxiliary link rod 90.

The auxiliary link rod 90 is linked horizontally between the bottom end of the minor rotary arm 50 and the end of spring 82. The spring 82 pulls the auxiliary link rod 90, which causes the minor rotary arm 50 to move toward the end of control cam 33. The pivot by minor rotary arm 50 causes the driver gear 36 to engage the driver gear 35 and the minor wheel 38 to press against the major wheel 37.

Figure 9:
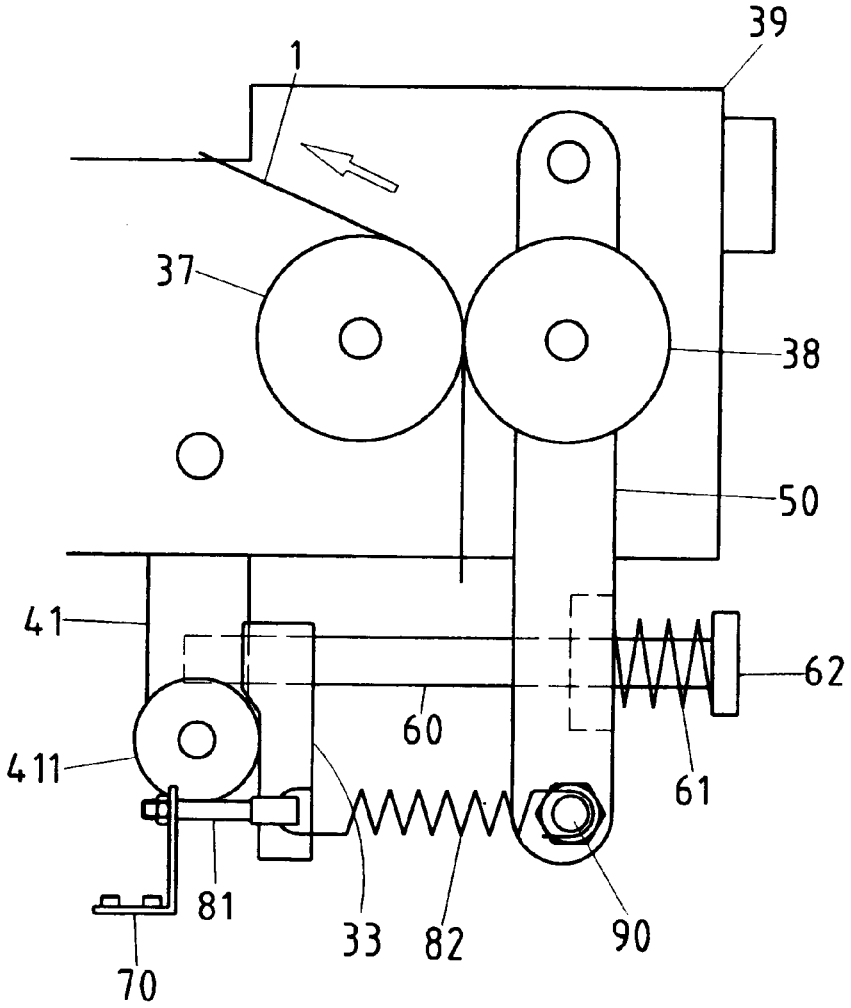
FIG. 9 shows a schematic plan view of the present invention in feeding the band.

As illustrated in FIGS. 6, 8, and 9, while the band 1 is fed forward for tying the band 1 around a box, the guide motor 34 drives the driver gear 35, which rotates the driver gear 36, so that the major wheel 37 and minor wheel 38 guide the band 1. At the same time, because the pressure between major wheel 37 and minor wheel 38 comes from the elasticity force of the spring 82 through the auxiliary link rod 90 and through the minor rotary arm 50, the pressure is not so tight but rather elastic. Under the elastic pressure of major wheel 37 and minor wheel 38 in feeding and guiding out the band 1, the band 1 will not curve nor deform.

Figure 10:
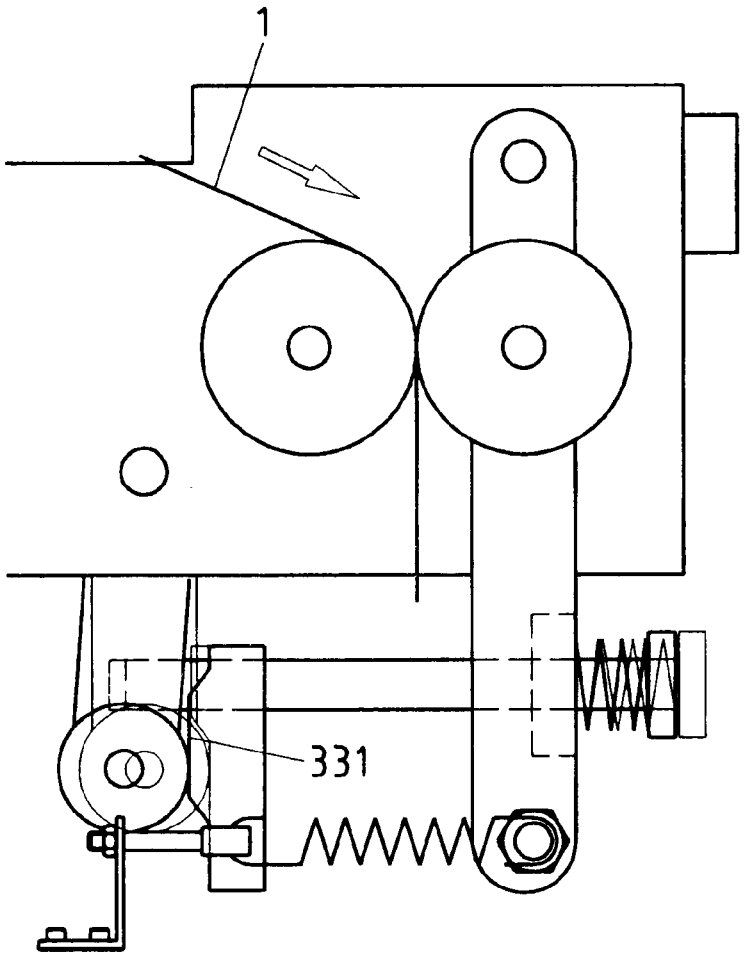
FIG. 10 shows a schematic plan view of the present invention in reversing the band.

In addition, as illustrated in FIGS. 6, 8, and 10, after the band 1 has been tied around the box and in order to tightly tie the box, the guide motor 34 revolves in the opposite direction, so that the major wheel 37 and minor wheel 38 guide and press the band in reverse. At the same time, the packaging machine uses a sensitive circuit element to sense that the band 1 is being used in reverse to tightly tie the box and that the band needs the band tension to increase from the original pressure. The circuit element makes the control motor 31 drive the control cam 33. As the control cam 33 revolves and rotates the guide wheel 411 of major rotary arm 41, the convex ridge 331 of control cam 33 contacts the guide wheel 411 which pushes the major rotary arm 41 and causes the arm 41 to pivot, so that the main link rod 60 drives the minor rotary arm 50 to similarly pivot. Therefore, the pressure on band 1 from the minor wheel 38 increases because the minor wheel 38 is connected to the increased pivoting upper minor rotary arm 50. As such, increased tension allows the band to tightly tie the box and cut the band 1 at the same time. The pressure of the major wheel 37 and minor wheel 38 in feeding the band and tying around the box comes from the elasticity spring 82 of spring component 80. This tension is lower than the tension of the major wheel 37 and minor wheel 38 in reversing the band. The control cam 33 adds tension by driving the major rotary arm 41 and minor rotary arm 50 to pivot and increase the pressure of the minor wheel 38 on the major wheel 37. Therefore, the present invention has a two phase operation of feeding and reversing the band. The band 1 only accepts the added tension of major wheel 37 and minor wheel 38 while in tightening the box. While the band 1 is relatively loose when it is feeding, the pressure of major wheel 37 and minor wheel 38 on band 1 is reduced. However, the band 1 still has tension during feeding so as to reduce deformation of the band. Thus, the present invention maintains the smooth appearance of the band and further maintains the effective operation of packaging.

The embodiment of the present invention described above is to be deemed in all respects as being illustrative and not restrictive. Accordingly, the present invention may be embodied in other specific forms without deviating from the spirit thereof. The present invention is therefore to be limited only by the scope of the following appended claim.

We claim:

1. A guide band packaging machine comprising:

a control motor mounted on a mounting board with a connector member, said connector member connected to a control cam, said control cam comprising a horizontally mounted shaft extending from the connector member to a guide motor; an end of said control cam having a convex ridge contacting a guide wheel of a link mechanism positioned below said guide motor, said guide motor comprising a motor which rotates a first driver gear mounted on a motor shell, said first driver gear being fixedly attached to a major wheel and rotatably engages a second driver gear, said second driver gear being fixedly attached to a minor wheel, said major wheel and said minor wheel pressing against each other so as to control a tension of a band during feeding and reversing of the band therebetween, said link mechanism connecting said control cam and said guide motor, said link mechanism comprising:

a major rotary arm, having a top end pivotally mounted on said motor shell of said guide motor, said major rotary arm having a bottom end facing a guide wheel of said control cam, said guide wheel being in contact with said control cam so that said major rotary arm axially pivots at a top end of said major rotary arm and moves horizontally towards said control motor;

a minor rotary arm, having a top end being pivotally mounted on said motor shell, said minor rotary arm having a point of pivotal mounting located away from said control cam and above said second driver gear, said second driver gear and said minor wheel being rotatably mounted on said minor rotary arm near a top end thereof and aligned with said first driver gear, a bottom end of said minor rotary arm extending downwardly towards said mounting board and having a block attached thereto, said block being aligned with said bottom end of said major rotary arm;

a main link rod connected horizontally between the respective bottom ends of said major rotary arm and said minor rotary arm, said mail link rod having a portion extending through said block, said portion of said main link rod having a spring fastened with a fixed button, said main link rod connected so that both of said major rotary and minor rotary arms pivot and move in correspondence;

a fixed element being mounted on said mounting board near a side of said control cam; and a spring component comprising a pull rod affixed to a top end of said fixed element and parallel to said control cam, said spring component further comprising a spring hooked to said pull rod and to an auxiliary link rod, said auxiliary link rod linked horizontally between said bottom end of said minor rotary arm and an end of said spring such that a puffing force on said auxiliary link rod causes said minor rotary arm to move toward said end of said control cam, said minor rotary arm pivotally causing said second driver gear to engage said first driver gear and said minor wheel to increase pressure against said major wheel.

* * * * *